United States Patent [19]

Landwehr et al.

[11] 4,271,776

[45] Jun. 9, 1981

[54] WORKPIECE FEEDING DEVICE FOR A SEWING MACHINE

[75] Inventors: Günter Landwehr; Horst Thiele, both of Bielefeld, Fed. Rep. of Germany

[73] Assignee: Kochs Adler AG, Bielefeld, Fed. Rep. of Germany

[21] Appl. No.: 77,143

[22] Filed: Sep. 19, 1979

[51] Int. Cl.[3] ..... D05B 27/22

[52] U.S. Cl. ..... 112/311; 112/318; 112/316

[58] Field of Search ..... 112/316, 315, 314, 317, 112/318, 311, 322

[56] References Cited

U.S. PATENT DOCUMENTS

| | | | |
|---|---|---|---|
| 2,265,605 | 12/1941 | Kucera | 112/311 X |
| 3,141,428 | 7/1964 | Reeber et al. | 112/318 |
| 3,485,193 | 12/1969 | Landwehr et al. | 112/322 |
| 4,152,995 | 5/1979 | Klundt | 112/318 |

*Primary Examiner*—H. Hampton Hunter

*Attorney, Agent, or Firm*—Max Fogiel

[57] ABSTRACT

In a sewing machine a workpiece feeding device having a lower feeding member intermittently and reversably driven and an upper feeding member in a steady contact with the workpiece and drivingly connected to the lower feeding member by means of connecting elements including one-way coupling means and a device arranged between the latter and the upper feeding member for interrupting or reversing the upper feed motion simultaneously when reversing the lower feeding member; different embodiments are described.

2 Claims, 17 Drawing Figures

Fig. 1
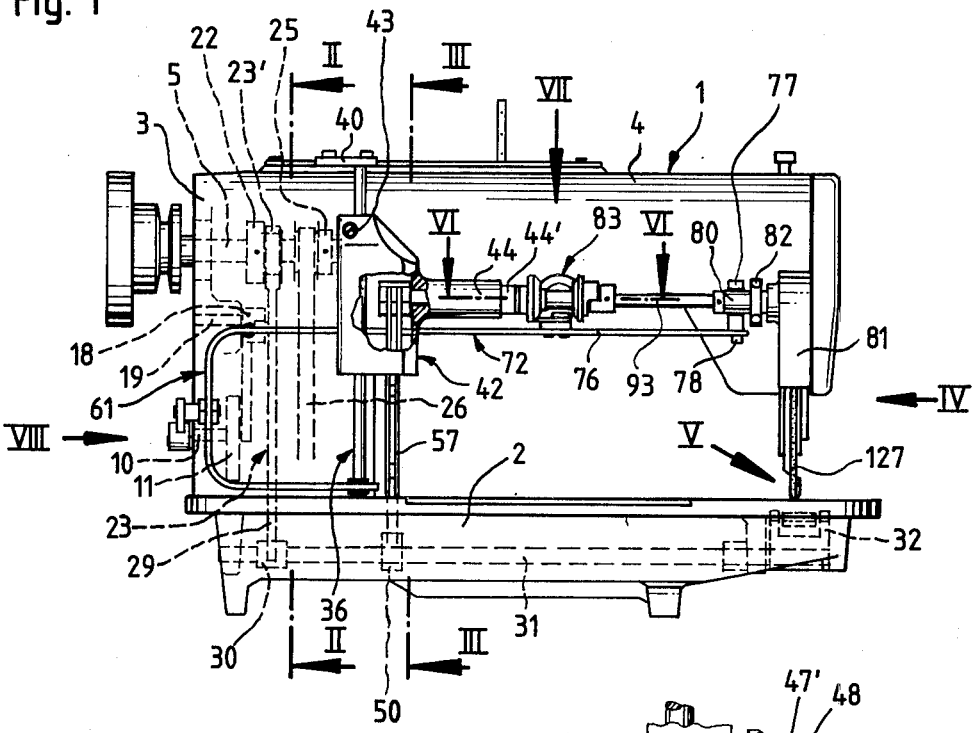
Fig. 2
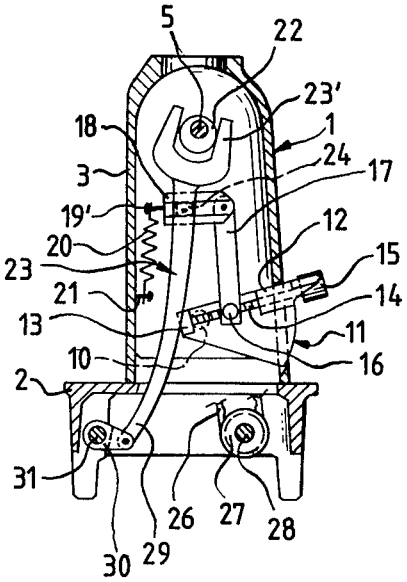
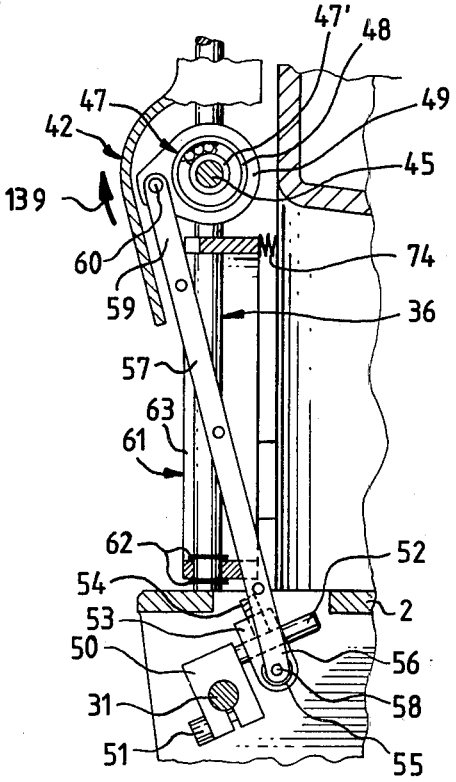
Fig. 3

Fig. 11
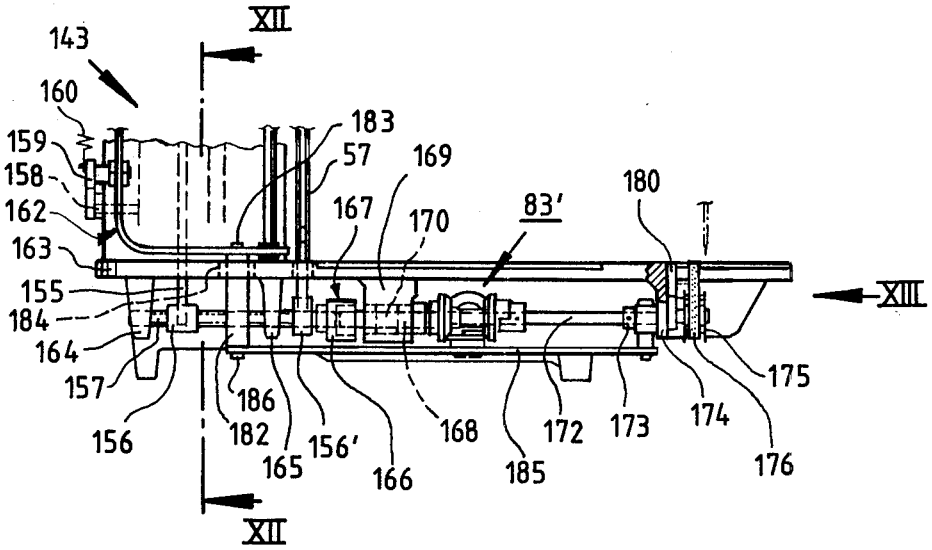
Fig. 13
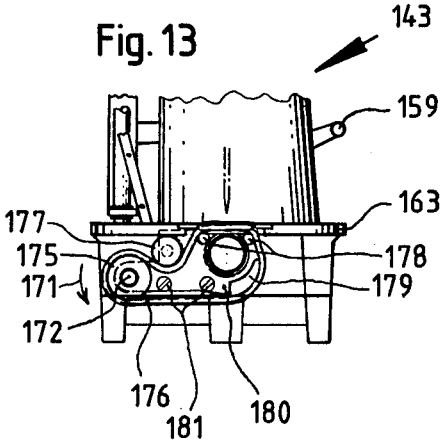
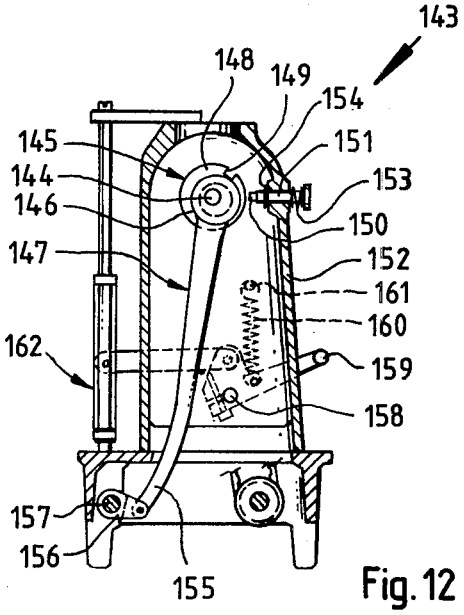
Fig. 12

WORKPIECE FEEDING DEVICE FOR A SEWING MACHINE

BACKGROUND OF THE INVENTION

The present invention relates to improvements of a workpiece feeding device in a sewing machine installed with a lower and an upper feeding mechanism, and more particularly to a feeding device comprising a driven upper endless feeding member such as a wheel or a tape steadily contacting the upper surface of a workpiece.

In general such endless feeding members are either continuously driven by an interposed reduction gear or in an intermittent manner by the application of ratchet means known as one-way couplings or overrunning elements. An endless feeding member is frequently applied in combination with another feeding system, at which a feed dog adjustably performs a four-motion feeding movement. In such a combination it has found advantageous and economical to combine a four-motion feeding system with an intermittent endless feeding system, since in a simple design a one-way coupling driving the endless feeding member may be drivingly connected to the adjustable four-motion feed system. Thus, both intermittent feeding systems are drivingly synchronized and adjustably connected and, in contrary to gear driven feeding systems, a stepless feed rate adjustment is obtained.

In the U.S. Pat. No. 3,141,428 it is described a sewing machine installed with a lower and an upper wheel feed, both conveniently driven by a mechanism including one-way coupling means, by which in this particular arrangement a quasi continuous feed of a workpiece is achieved.

From the U.S. Pat. No. 3,485,193 it is known a sewing machine having a combined lower and upper feeding system, at which a lower intermittently acting feed dog cooperating with a presser foot is assisted by an upper feed roller. As illustrated and described, the upper feed roller is intermittently driven by a ratchet means connected to the lower feeding mechanism.

In a pending patent application Ser. No. 743,061, filed Feb. 7, 1977, now abandoned, there is disclosed a sewing machine installed with a four-motion feed dog and an upper endless feeding belt arranged behind or laterally to a presser foot.

All aforesaid sewing machines are installed with workpiece feeding systems comprising one-way coupling means. Besides the mentioned advantages, one-way couplings have the shortcoming to convert an oscillating input movement into an intermittently rotating movement in one direction only. Due to this fact, endless feeding members driven in such a manner must be rendered inoperative in a reversed feed mode, which becomes necessary for example on tacking operations. For this purpose, a reverse feed regulator for reversing the lower feed dog is shiftably connected with the endless feeding mechanism for simultaneously lifting the endless feeding roller or belt from the workpiece, as described in detail in the last two cited references. In order to assure a stitch formation while reverse stitching, the presser foot must remain in its lowered position. On the other hand in forward sewing mode the presser foot frictionally wipes on the upper surface of the workpiece and in conjunction with the upper feed member a stress is induced to the material and to the threads of the stitch which, especially on light materials, causes puckering. Furthermore, the arrangement of a presser foot and a feed roller or a feed belt results in an enlarged area contacting the workpiece which resistively effects the sewing of profiled stitchlines. Finally, such arrangement requires some space which is obstructious on certain operations.

SUMMARY OF THE INVENTION

It is a primary object of the invention to create a reversible workpiece feeding mechanism, at which a lower feeding member is assisted by an endless upper feeding member.

It is a further object to provide a feeding mechanism of the aforesaid type, the feed rate of which may be stepless adjusted.

It is still another object of the invention to provide an improved reversible feeding mechanism having an upper endless feeding member arranged in the neighbourhood of the needle for forming a workpiece holddown being effective in both sewing directions in order to prevent a workpiece from puckering and to improve the ability to perform profiled stitchlines.

The above listed objects are simply achieved by driving the endless upper feeding member by means of a one-way coupling including a reversing device shiftably connected with a reversing lever for the lower feeding member. In such a manner the upper feeding member represents the only workpiece holddown, by which a narow construction is achieved and material puckering is eliminated.

According to a modified embodiment, the endless upper element may be disconnected from the one-way coupling as the feed is reversed. Thus, the endless upper feeding member idlingly acts as a workpiece holddown cooperating with the reversed lower feeding member. In such a feeding system the advantages of a driven upper endless feeding member and a lower feeding member are combined with the ability to perform tacking operations, wherein the reversed drive of the upper feeding member is omitted. This feeding mechanism is best suited for performing medium or heavy leather sewing operations at which tacking becomes necessary.

Other objects, advantages and features of the invention will appear from the detailed description of the preferred and modified embodiments which will now be given in conjunction with the accompanying drawings.

BRIEF DESCRIPTION OF THE DRAWINGS

FIG. 1 is a rear plan view of a sewing machine incorporating a preferred embodiment of the present invention;

FIG. 2 shows a section taken along line II—II of FIG. 1 with the stitch regulating mechanism;

FIG. 3 shows a partial vertical section taken along line III—III of FIG. 1;

FIG. 11 is a partial rear plan view of a different sewing machine;

FIG. 12 shows a section taken along line XII—XII of FIG. 11;

FIG. 13 is a view in direction of arrow XIII in FIG. 11;

DESCRIPTION OF THE PREFERRED AND MODIFIED EMBODIMENTS

Figure 4:
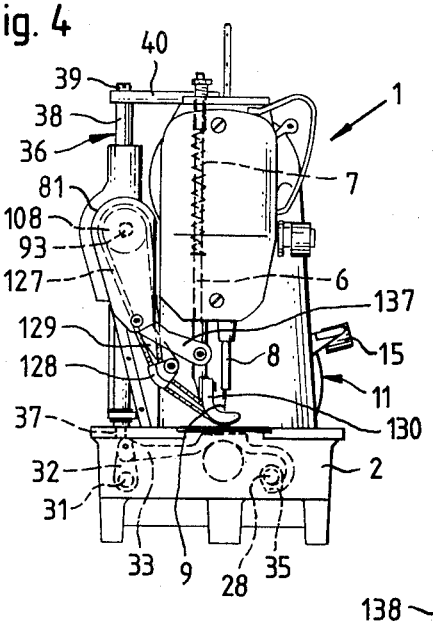
FIG. 4 shows a side view in direction of arrow IV in FIG. 1.

Referring now more particularly to the drawings, in FIG. 1 there is shown a sewing machine 1 with a base plate 2 receiving a standard 3 extending as an overhanging arm 4, in which an arm shaft 5 is journaled. The overhanging arm 4 slidably receives a presser bar 6 (FIG. 4), which is downwardly forced by a spring 7. Furthermore, in the overhanging arm 4 there is pivoted a needle bar 8 carrying a needle 9.

Within the standard 3 there is journaled a shaft 10 carrying a shift lever 11, into bearings 12, 13 of which a threaded spindle 14 having a knurled knob 15 is received (FIG. 2). The threaded spindle 14 engages with a threaded bolt 16 pivoted in a link 17, which is hingedly connected to a guide block 18 journaled at a bolt 19 in the standard 3. (FIG. 1). As obvious from FIG. 2, the guide block 18 is provided with a pin 19', on which a spring 20 acts, which is suspended at a pin 21 in the standard 3.

Figure 5:
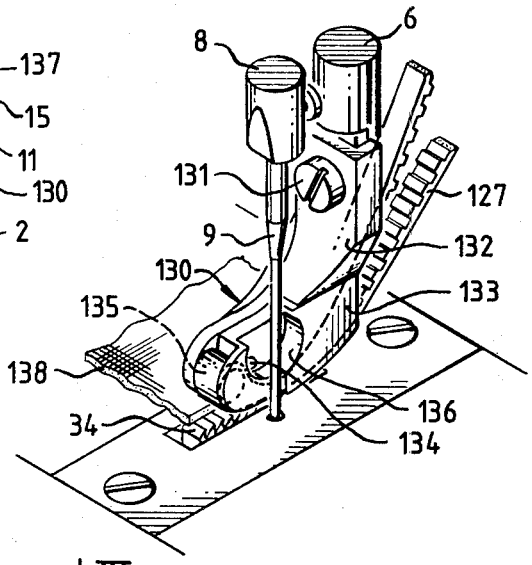
FIG. 5 is a perspective view in direction of arrow V in FIG. 1.

To the arm shaft 5 (FIGS. 1 and 2) there is secured an eccentric 22 cooperating with a forked end 23' of a pitman 23, which is guided in the guide block 18 by means of a pivotally arranged slide block 24. Moreover, the arm shaft 5 carries a grooved pulley 25 receiving a timing belt 26, which drives a grooved pulley 27 (FIG. 2) on a shaft 28 pivoted in the base plate 2. The free end 29 of the pitman 23 is hingedly connected to a lever 30 fastened on an oscillating shaft 31, which is pivoted in the base plate 2. To the oscillating shaft 31 there is fastened a crank 32 (FIG. 4), which receives a feed bar 33 supporting a feed dog 34 (FIG. 5). As illustrated in FIG. 4, the feed bar 33 is hingedly linked to a pitman 35 received in a not shown eccentric of the shaft 28.

The sewing machine 1 is further provided with a vertical bar 36 (FIG. 4), one end 37 of which is received in the base plate 2 and the other end 28 of which is fastened by a screw 39 to a plate 40 mounted to the standard 3 by means of screws 41. To the vertical bar 36 there is clamped a housing 42 by a screw 43 (FIG. 1). The housing 42 is formed with a cylindrical part 44 including a reduced portion 44', in which a first shaft 45 is pivoted by means of two bearings 46, one of which is illustrated only in FIG. 6. According to FIG. 3, on the first shaft 45 is pressed an inner ring 47' of an one-way coupling 47, the outer ring 48 of which is received in a rocker arm 49. Furthermore, a lever 50 is clamped to the oscillating shaft 31 by means of a screw 51. The lever 50 is provided with a bolt 52 for receiving a link 53 secured thereto by a set screw 54. The link 53 carries a bearing 55, in which one end 56 of a connecting bar 57 is pivoted by a bolt 58. The free end of the connecting bar 57 is hinged to the rocker arm 49 by a bolt 60.

Figure 8:
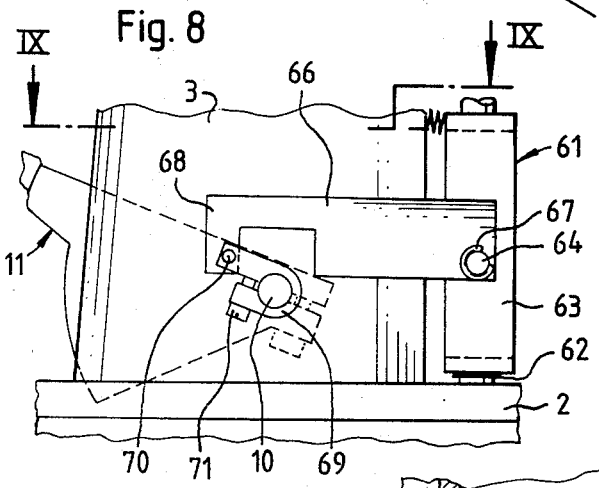
FIG. 8 is an enlarged partial side view in direction of arrow VIII in FIG. 1.
Figure 9:
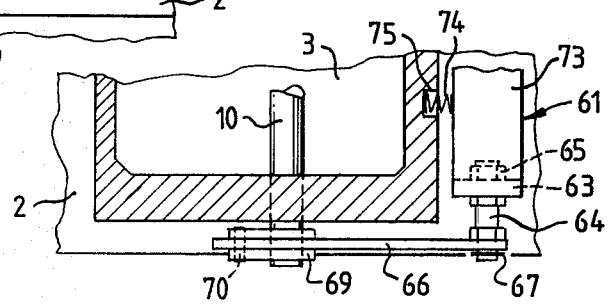
FIG. 9 is a partial section taken along line IX—IX of FIG. 8.
Figure 10:
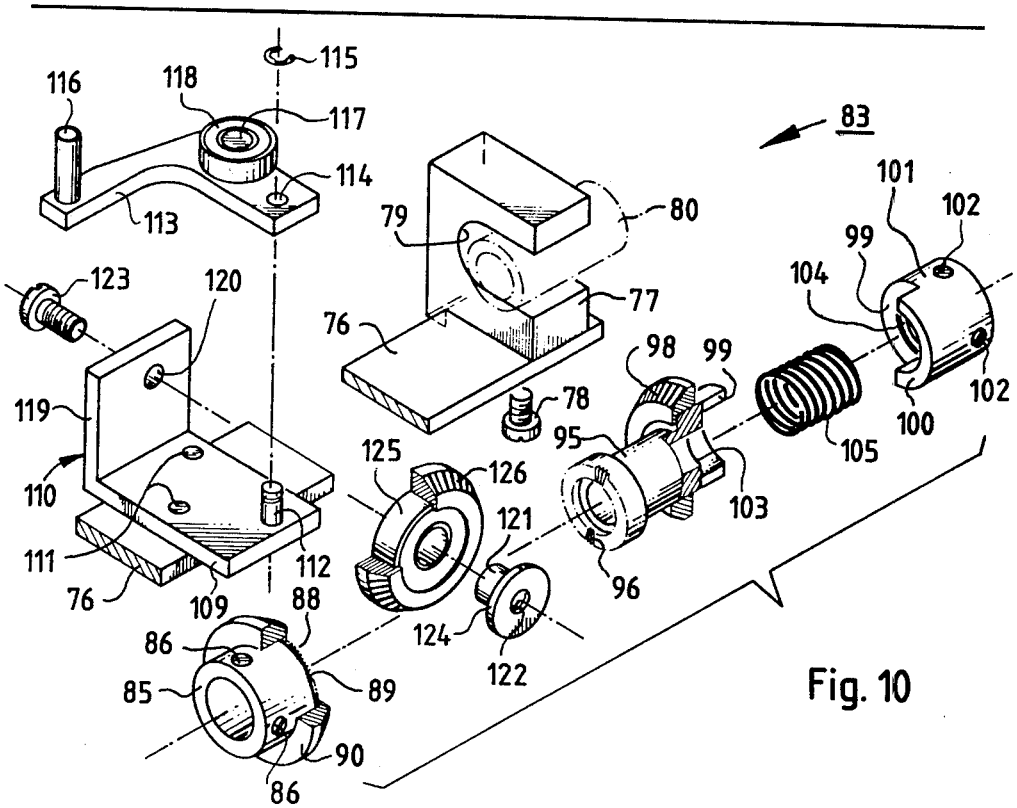
FIG. 10 represents an exploded perspective view of the reversing device, at which the shafts are omitted.

The vertical bar 36 movably receives an U-shaped shift lever 61 (FIG. 1), which is axially secured thereto by two retaining rings 62 (FIG. 3). The shift lever 61 is formed with a web 63, to which a stud 64 is fastened by a screw 65 (FIGS. 8 and 9). On the stud 64 there is hingedly received a link 66 axially secured thereto by a retaining ring 67. The free end 68 of the link 66 is pivoted in a lever 69 by a bolt 70. The lever 69 is clamped by a screw 71 to the shaft 10 connected with the shift lever 11. The shift lever 61 is formed at one leg as a two-armed lever 72 (FIG. 1), on one arm 73 of which rests a spring 74 supported in a blind hole 75 of the standard 3 (FIGS. 8 and 9). To the end of the other arm 76 there is fastened a block 77 by a screw 78 (FIGS. 1 and 10). The block 77 is formed with an U-shaped cutout 79 movably embracing a bearing 80. The latter pivotally receives a housing 81 (FIG. 1), which is mounted to the overhanging arm 4 by screws 82.

Figure 6:
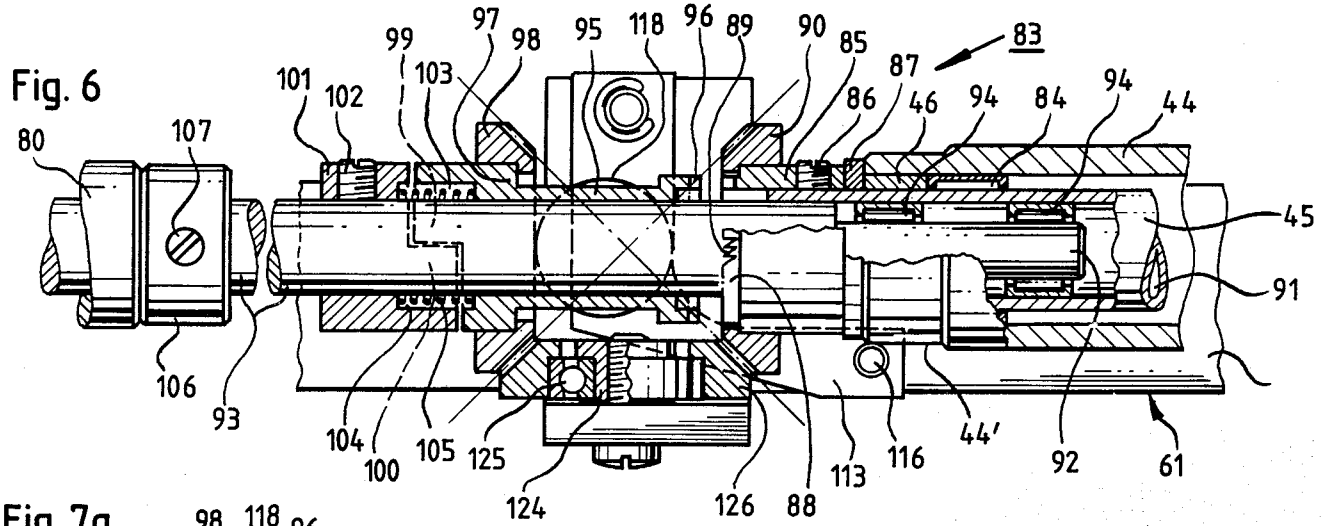
FIG. 6 is an enlarged sectional view taken along line VI—VI of FIG. 1.

The other arm 76 of the shift lever 61 cooperates with a device 83, which now will be described in connection with FIGS. 6 and 10. Within the cylindrical part 44 there is located an one-way coupling 84 allowing a rotation of the intermittently moved first shaft 45 in a direction of an arrow 139 (FIG. 3) only. On the first shaft 45 (FIG. 6) there is provided a hub 85 secured by a set screw 86. The hub 85 axially rests on a thrust washer 87 supported by the reduced portion 44', and is provided with a reduced flange 88 having radial teeth 89. Furthermore, the hub 85 carries a first bevel gear 90 by means of a press fit. The first shaft 45 has a blind hole 91 for receiving a reduced end 92 of a second shaft 93 by means of bearings 94. To the second shaft 93 is freely journaled a bushing 95, the one front side of which has radial teeth 96. The other side of the bushing 95 is formed with a shoulder 97, to which a second bevel gear 98 is fastened by means of a press fit. The shoulder 97 terminates in a jaw 99 engaging with a jaw 100, which is a part of a collar 101 secured to the second shaft 93 by a screw 102. Both, the bushing 95 and the collar 101 are provided with counterbores 103, 104 for receiving a spring 105. The second shaft 93 is axially positioned by a collar 106 secured by a set screw 107, and a grooved pulley 108 is pressed thereto (FIG. 4).

As best illustrated in FIG. 10, to the other arm 76 of the shift lever 61 there is attached one leg 109 of an angle 110 by means of rivets 111. A pin 112 arranged at the leg 109, pivotally receives an angular lever 113 at a bore 114, whereat the shift lever 113 is axially secured by a retaining ring 115. The angular lever 113 is provided with a stud 116 and a lug 117, to which a bearing 118 is pressed. An upright leg 119 of the angle 110 is formed with a bore 120 for mounting a hub 121 by means of an internal thread 122 and a screw 123. The hub 121 has a shoulder 124 for axially securing a bearing 125, to which a third bevel gear 126 is pressed.

Referring to FIG. 4, the grooved pulley 108 intermittently drives a timing belt 127, which extends downwardly via a guide block 128 carried by a bar 129 of the housing 81, to a presser foot 130 fastened to the presser bar 6 by a screw 131 (FIG. 5). The presser foot 130 is formed with guide grooves (not shown) located at a bracket 132 and a guide part 133, at which the last two parts 132, 133 are held together by a screw 134 and support a roller 135 in front of the needle 9 as to deviate the timing belt 127 in cooperation with the not shown guide grooves as illustrated with dotted lines in FIG. 5.

Furthermore, the guide part 133 is formed with a recess 136 as not to interfere with the reciprocating needle bar 8. In order to keep the timing belt 127 always in a stressed condition as the presser foot 130 moves down- or upwardly, the presser bar 6 hingedly receives a link 137 connected jointly to the housing 81 pivoted at the overhanging arm 4 as aforesaid.

The operation of the described sewing machine incorporating the novel workpiece feeding device is as follows:

It may be assumed, that the shift lever 11 is in its upper position a shown in FIG. 2. In this position, the feeding of a workpiece 138 (FIG. 5), while sewing, may be considered as the forward movement. In a known manner the feed dog 34 intermittently acts upon the lower surface of the workpiece 138. From FIGS. 1 and 3 it will be evident, that an intermittent motion is transferred from the oscillating shaft 31 in the base plate 2 to the first shaft 45. Due to the coaction of the one-way couplings 47 and 84, the first shaft 45 will be intermittently driven in the direction of the arrow 139 (FIG. 3) as the feed dog 34 forwardly advances the workpiece 138 (FIG. 5). Both, the lower and the upper feed increment may be matched by means of altering the position of the link 53. In order to reverse the feed, the operator pushes the shift lever 11 downwardly (FIG. 2). Due to the coaction of the shift lever 11, the spindle 14, the link 17 and the guide block 18, the stroke for reversing the feed remains constantly independent of the adjusted feed rate. By pushing the shift lever 11 downwardly, the shift lever 61 will be shifted by the action of the lever 69 and the link 66 into a position as shown in FIG. 6.

Figure 7B:
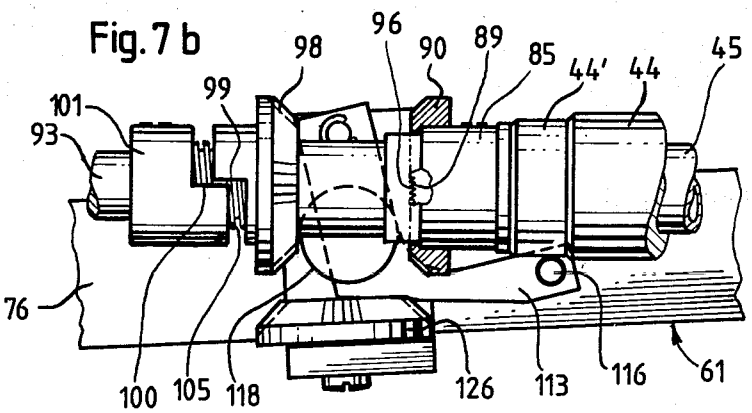
FIGS. 7*a* and 7*b* are enlarged top plan views in direction of arrow VII showing the novel device in different shifted positions.
Figure 7A:
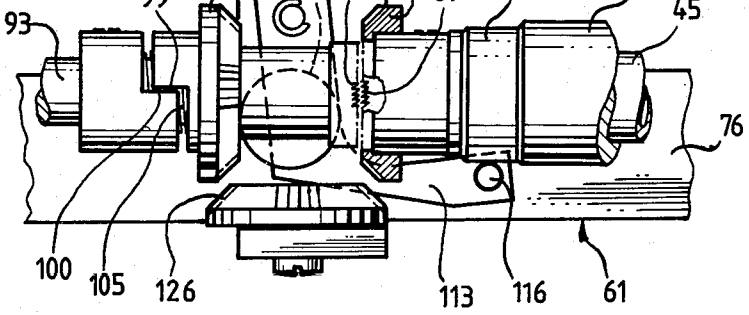

The operation of the device 83 (FIG. 6) will now be described. The intermittent drive motion of the first shaft 45 is transmitted via the hub 85 and the first bevel gear 90 to the third bevel gear 126, which reversingly transmits the motion via the second bevel gear 98, the bushing 95 via the jaws 99 and 100 and the collar 101 to the second shaft 93. As the third bevel gear 126 is kept in its position by the other arm 76 of the shift lever 61, the position of the bushing 95 is determined by the bearing 118 abutting against the second bevel gear 98 caused by the action of the spring 105. When shifting the other arm 76 of the shift lever 61 into a position as shown in FIG. 7*a*, the third bevel gear 126 will be withdrawn into an idling position, whereas the bushing 95 will be axially displaced by the spring 105 in connection with the relative movement of the angular lever 113, the stud 116 of which rests against the reduced portion 44'. In FIG. 7*b* the device 83 is shown in a different position, at which the spring 105 forces the radial teeth 96 and 89 into a meshing position as all bevel gears 98, 126 and 90 are inactive. In such condition, the device 83 transmits the intermittent movement of the first shaft 45 via the hub 85, the radial teeth 89 and 96, the jaws 99 and 100 and the colar 101 to the second shaft 93 in equal direction, i.e. in forward sewing direction.

Figure 15:
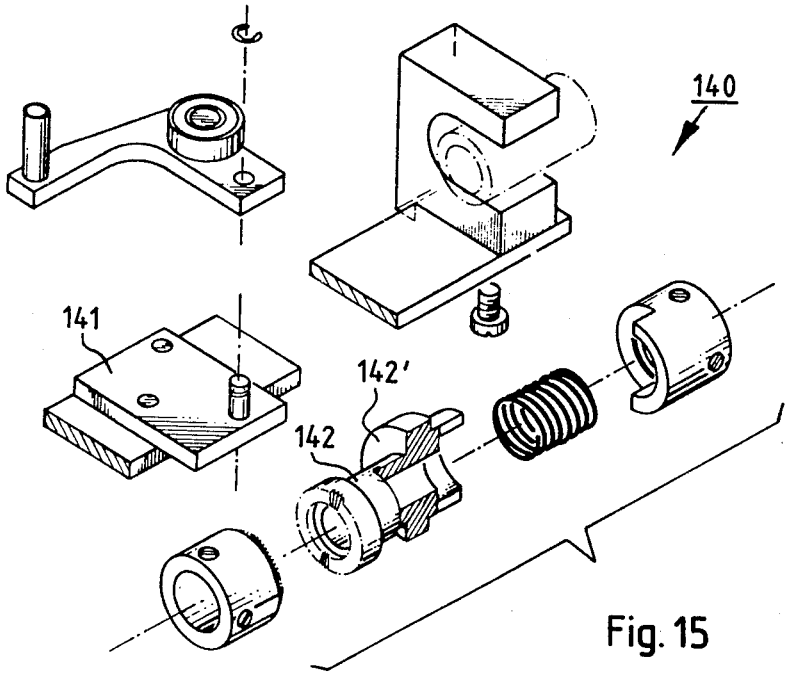
FIGS. 14*a* and 14*b* are enlarged top plan views similar to the direction of arrow VII in FIGS. 7*a* and 7*b* and showing a modified device in different shifted positions and FIG. 15 is an enlarged exploded view of the modified device, at which the shafts are omitted.

In a modified embodiment the above described device 83 is substituted by a coupling device 140 (FIGS. 14*a*, 14*b* and 15), which represents a similar, however simplified construction as best seen when comparing FIGS. 10 and 15.

In FIG. 15 only those parts are designated which differ from those parts shown in FIG. 10:

The other arm 76 of the shift lever 61 is provided with a plate 141 installed with a pin 112 and fastened as aforesaid (FIG. 15). In contrary to the device 83 shown in FIG. 10, the coupling device 140 (FIG. 15) is not provided with any bevel gears. Furthermore, a sleeve 142 is profiled with a rim 142'.

Figure 14A:
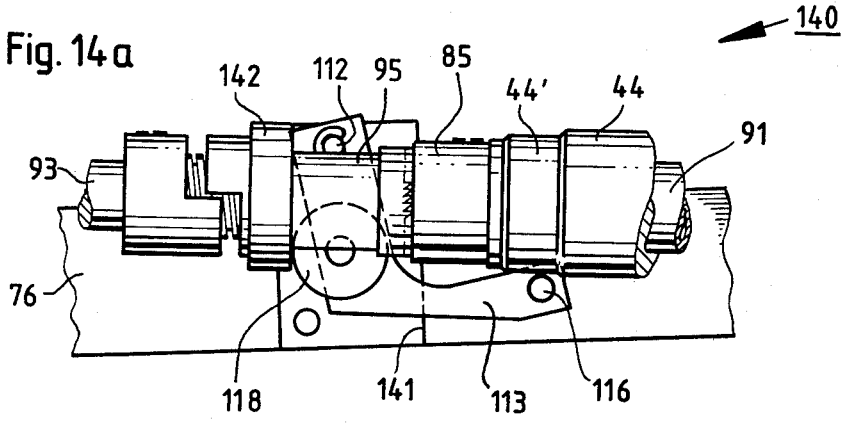
Figure 14B:
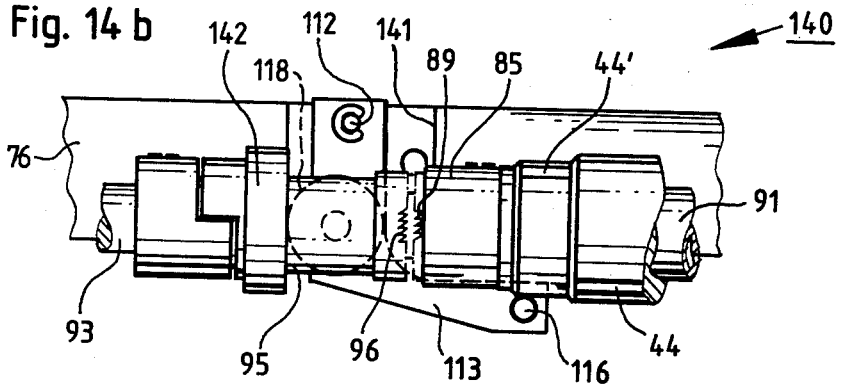

The operation of the modified embodiment may be explained in connection with FIGS. 14*a* and 14*b*:

In normal forward sewing operation, the workpiece 138 is advanced by the feed dog 34 and the timing belt 127 (FIG. 5). Under these conditions, the coupling device 140 transmits the drive motion to the timing belt 127 (FIG. 14*a*). In a reversed feed mode, the coupling device 140 is similarly shifted as above described and illustrated in FIG. 14*b*, in order to disengage the radial teeth 89 and 96 and to put the timing belt 127 into an idling condition. Thus, the timing belt 127 acts as a non-driven roller foot while the feed dog 34 performs a reversed feed motion.

Finally, another modified embodiment of the present invention will now be described in connection with FIGS. 11, 12 and 13:

In FIG. 12 a section of a sewing machine 143 is shown, at which an arm shaft 144 is installed with an adjustable eccentric 145 embraced by an upper end 146 of a pitman 147.

The eccentric 145 is provided with an adjusting ring 148 formed with a slot 149 cooperating with a stud 150 of an adjusting bolt 151 arranged in a standard 152 of the sewing machine 143. The adjusting bolt 151 is forced into a basic non-interfering position by a spring 153 and is secured axially by means of a retaining ring 154. The pitman 147 is jointly connected at its lower end 155 to a left crank 156, which is firmly arranged on a rock shaft 157. Within the standard 152 there is pivoted a shaft 158 firmly receiving a feed reversing regulator 159, which is forced upwardly by a spring 160 acting on said regulator 159 and suspended on a pin 161 in the standard 152. Similar as shown in FIGS. 8 and 9, the shaft 158 is shiftably connected to a shift lever 162 (FIGS. 12 and 11) pivoted at the sewing machine 143 shown such as in FIG. 1.

Referring now to FIG. 11, the sewing machine 143 has a base plate 163, in bearings 164 and 165 of which the rock shaft 157 is journaled. The latter furthermore firmly receives a right crank 156', to which the aforesaid connecting bar 57 is hinged. Similar as described in detail in the foregoing preferred embodiment and as shown in FIGS. 3 and 1, the upper timing belt 127 is driven via the one-way coupling 47 and the device 83. The rock shaft 157 oscillates an outer ring 166 of a one-way coupling 167, which intermittently drives an intermediate shaft 168 pivoted in a bearing 169 of the base plate 163. Furthermore, within the bearing 169 there is arranged a one-way coupling 170 allowing a rotation of the intermittently moved intermediate shaft 168 in a direction of an arrow 171 only. (FIG. 13). As illustrated in FIG. 11, the intermediate shaft 168 terminates in a lower device 83', which is situated in the base plate 163 and equally constructed such as the aforesaid device 83 shown in FIG. 6. The lower device 83' drives an output shaft 172 secured by a collar 173 and pivoted in a bearing 174 of the base plate 163. The output shaft 172 firmly receives a grooved pulley 175 (FIGS. 11 and 13) cooperating with a timing belt 176, which is guided by rollers 177, 178 and a guide 179 arranged on a bracket 180 fastened to the base plate 163 by screws 181. As shown in FIG. 11, the shift lever 162 is installed with a connecting bar 182 secured thereto by a screw 183. The connecting bar 182 extends through a recess 184 located in the base plate 163 for carrying a lever 185 fastened by a screw 186. The lever 185 is equally formed as the above described two-armed lever 72 shown in FIG. 1, and shiftably cooperates with the device 83' (FIG. 11).

In forward sewing operation, the workpiece 138 at its upper surface (FIG. 5) is advanced by the timing belt 127 and—instead of the feed dog 34 as illustrated—by the the timing belt 176 at its lower surface. The feed rate, i.e. length of a stitch, may be adjusted at the eccentric 145 by means of the adjusting bolt 151 as the sewing machine 143 is inoperative. For reversing the feed, the operator pushes the feed reversing regulator 159 downwardly thus simultaneously shifting the devices 83 and 83' reversing the feed motions.

Having now described my invention with reference to the embodiments illustrated in the drawings, what I desire to protect by Letters Patent is set forth in the appended claims.

I claim:

1. In a sewing machine having a workpiece supporting base plate, a standard and an overhanging arm carrying a presser bar, a movable needle and a longitudinally extending arm shaft for driving said needle, a workpiece feeding device having a lower feeding means including a feed dog engaging the lower surface of a workpiece, a mechanism synchronously driven relative to said needle for imparting a four motion feeding movement to said feed dog and having regulating means for reversing said feeding movement while said sewing machine is operative or inoperative, and transmitting means connecting said mechanism with said feed dog including an oscillating shaft transmitting a partial movement of said four motion feeding movement as a feed and idling motion; an upper feeding means having an upper feeding element arranged to cooperate with said feed dog in the area of said needle in a steady contact with the upper surface of said workpiece, a bracket secured to said presser bar carrying said upper feeding element and means for driving said upper feeding element comprising a housing clamped to a vertical bar fastened to said standard, a first shaft pivoted in said housing, a one-way coupling received on said first shaft, a driving connection between said oscillating shaft and said one-way coupling, a second shaft pivoted on said overhanging arm and drivingly connected to said upper feeding element, and a device having a clutch element and a reversing gear means shiftably connecting said first shaft with said second shaft, and a shifting mechanism between said regulating means and said clutch element and said reversing gear means for an alternate engagement.

2. A workpiece feeding device for a sewing machine as claimed in claim 1, wherein said first shaft and said second shaft are coaxially arranged, said clutch element includes a hub shaped with radial teeth and fastened to said first shaft, a bushing provided with radial teeth matching with said radial teeth of said hub, said bushing being displaceably received on said second shaft and having a shoulder, a counterbore and a jaw, a collar fastened to said second shaft and formed with a counterbore and a jaw mating with said jaw of said bushing, and a spring received in said counterbores; said reversing gear means includes a first bevel gear fastened to said hub, a second bevel gear secured to said shoulder of said bushing, a third bevel gear pivotally arranged on the upright leg of an angle fastened to the other arm of a shift lever hingedly secured to said vertical bar; and said shifting mechanism between said regulating means and said clutch element and said reversing gear means includes a linkage having a lever and a link connected to said shift lever, and an angular lever pivoted on said angle and provided with a stud cooperating with said housing and carrying a bearing abutting against said shoulder for axially positioning said bushing in conjunction with said spring.

* * * * *